United States Patent [19]

Noda

[11] 4,364,659

[45] Dec. 21, 1982

[54] CONTROLLING TONER CONCENTRATION OF DRY DEVELOPING AGENT IN ELECTROPHOTOGRAPHY

[75] Inventor: Nobutaka Noda, Kawasaki, Japan

[73] Assignee: Katsuragawa Electric Co., Ltd., Japan

[21] Appl. No.: 149,715

[22] Filed: May 14, 1980

[30] Foreign Application Priority Data

Jun. 1, 1979 [JP] Japan ..... 54-67535

[51] Int. Cl.[3] ..... G03G 15/09

[52] U.S. Cl. ..... 355/14 D; 355/3 DD; 118/689

[58] Field of Search ..... 355/3 DD, 14 D; 118/653, 656, 657, 658, 689, 690; 222/DIG. 1

[56] References Cited

U.S. PATENT DOCUMENTS

| | | | |
|---|---|---|---|
| 3,892,672 | 7/1975 | Gawron | 355/3 DD X |
| 3,999,687 | 12/1976 | Baer et al. | 118/689 X |
| 4,168,901 | 9/1979 | Ito et al. | 355/3 DD |
| 4,226,525 | 10/1980 | Sakamoto et al. | 355/14 D |
| 4,276,854 | 7/1981 | Fujita et al. | 355/3 DD X |

FOREIGN PATENT DOCUMENTS

| | | | |
|---|---|---|---|
| 2837274 | 5/1979 | Fed. Rep. of Germany | 355/14 D |

*Primary Examiner*—Gene Z. Rubinson
*Assistant Examiner*—Keith E. George
*Attorney, Agent, or Firm*—Martin Novack

[57] ABSTRACT

A method and a device for controlling a toner concentration of a dry developing agent used in an electrophotographic apparatus wherein an electrostatic latent image is developed by a dry developing agent including toner and magnetizable carrier used to be circulated, and wherein a toner is appropriately and timely supplied to the developing agent to maintain a toner concentration within a predetermined value. The developing agent is directed to flow on an inclined member disposed on a portion of a path of circulation of the developing agent, and when a depth of the flow of the developing agent on the inclined member is reduced below a predetermined value, the toner is supplied to the developing agent.

7 Claims, 11 Drawing Figures

CONTROLLING TONER CONCENTRATION OF DRY DEVELOPING AGENT IN ELECTROPHOTOGRAPHY

BACKGROUND OF THE INVENTION

This invention relates to a method and a device for controlling a toner concentration of a dry developing agent used in an electrophotographic apparatus wherein an electrostatic latent image is developed by a two-component dry developing agent including toner and magnetizable carrier.

In such an apparatus, it is required to maintain the toner concentration of the developing agent, which is contained in a developing device thereof and serves to develop the electrostatic latent image, within a range capable of producing an optimum copy image. For this purpose, there have hitherto been known various methods, such as ones (1) for controlling the toner concentration of the developing agent by supplying a determined amount of toner to the developing agent stored in the developing device at determined intervals of the copy cycles, (2) for controlling the toner concentration of the developing agent by causing the passage of the developing agent through a funnel-shaped member having an electrical winding to detect changes in the permeability of the developing agent and varying the rate of supply of the toner to the developing agent in response to the changes in the permeability, and (3) for controlling the toner concentration of the developing agent by providing a restricted passage in the developing device for by-passing the developing agent, detecting the volume of the agent flowing through the passage and varying the rate of supply of the toner to the developing agent in response to changes in the volume of the developing agent. However, the method (1) is disadvantageous in that when a large number of copies is successively made by using an original having a relatively large black area, for example, a large amount of toner of the developing agent will be spent to make the toner concentration lowered below an appropriate value thereby degrading the image quality. In the methods (2) and (3), it is also disadvantageous that the devices are complicated.

SUMMARY OF THE INVENTION

It is an object of the present invention to provide a method and a device for controlling the toner concentration of a dry developing agent used in an electrophotographic apparatus in a simple and convenient form.

DESCRIPTION OF THE PREFERRED EMBODIMENT

Figure 1:
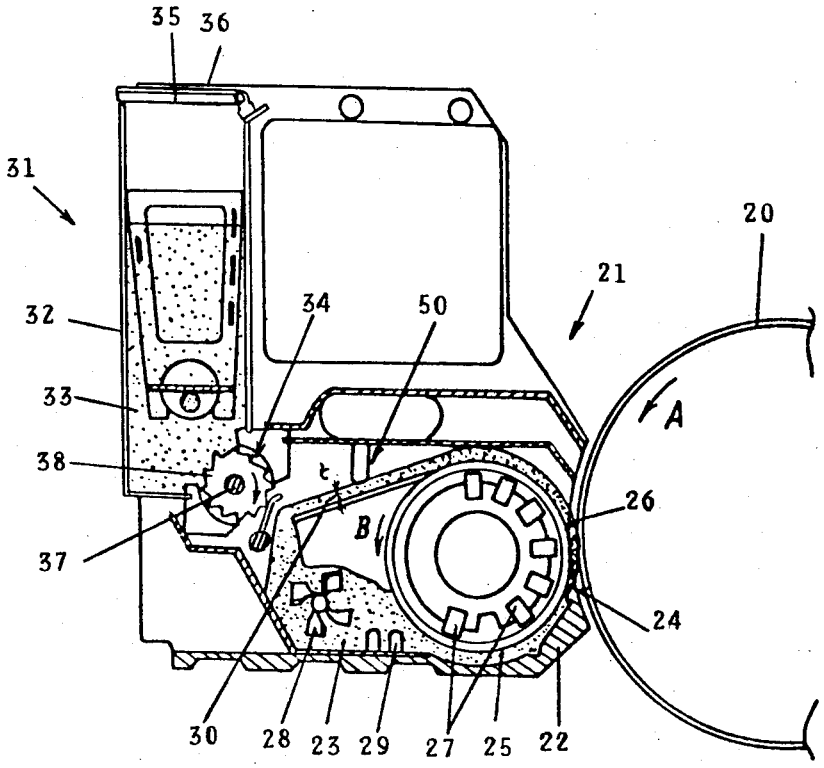
FIG. 1 is a schematic sectional view of a part of an electrophotographic apparatus which includes a developing device incorporating an embodiment of a device for controlling the toner concentration of a dry developing agent according to this invention.

Referring first to FIG. 1, there is shown an electrophotographic apparatus comprising a photosensitive drum 20 which is, in operation, rotated in a direction of an arrow A and on which an electrostatic latent image corresponding to an original to be copied is formed during its rotation by a known method, such as one disclosed in U.S. Pat. No. 3,752,572, and a developing device 21 provided adjacent to the photosensitive drum 20.

The developing device 21 includes a casing 22 which stores a developing agent 23 including toner, such as colored synthetic resin particles, and magnetizable carrier, such as iron particles. The casing 22 has an opening 24 formed adjacent to the periphery of the drum 20. Within the casing 22, there is provided a cylindrical hollow sleeve 25 made of non-magnetic metallic material and extending in parallel with the axis of the photosensitive drum 20, the sleeve being rotatably supported by side walls of the casing 22 such that a part of the periphery of the sleeve 25 is slightly protruded outwardly from the opening 24. The sleeve 25 is rotated in a direction of an arrow B by a driving device (not shown), in operation. Within the sleeve 25, there is provided a fixed magnet assembly 26 having a plurality of spaced rod-like magnet pieces 27 which extend in parallel with the axis of the sleeve 25. The magnet pieces 27 are disposed circumferentially of the assembly to have a polarity opposite to that of adjacent ones of the pieces. The developing agent 23 is agitated and triboelectrically charged by agitating members 28, 29 and then attracted by the magnetic force of the magnet pieces 27 to the periphery of the sleeve 25 to form a magnetic brush. The magnetic brush is brought into contact with the peripheral surface of the photosensitive drum 20 to develop the electrostatic latent image formed thereon to produce a toner image. The developing agent which has participated in the development of the image is removed from the periphery of the sleeve 25 by a fixed scraping plate 30 having a flat upper surface. The scraping plate 30 is disposed to be contacted at its leading end with the outer periphery of the sleeve 25 to transfer the developing agent from the sleeve to the plate. The plate 30 is inclined in respect of the horizontal plane to facilitate the flow of the developing agent on the plate away from the sleeve 25.

Provided on an upper portion of the casing 22 is a toner supply device 31 for supplying toner to the interior of the casing 22. The toner supply device 31 includes a storage tank 32 for storing toner 33 and having a lower opening in communication with the interior of the casing 22 through a metering means 34. The toner is filled into the storage tank 32 through an upper opening 35 which is normally closed by a lid 36 hinged thereto. The metering means 34 has a rotary shaft 37 rotatably mounted on side walls of the casing 22 via bearings (not shown). The shaft 37 is fixed with a supply roller 38 having a plurality of longitudinally extending grooves on its periphery, and as the supply roller 38 rotates a predetermined amount of the toner 33 is supplied by the grooves to the interior of the casing 22.

Figure 2:
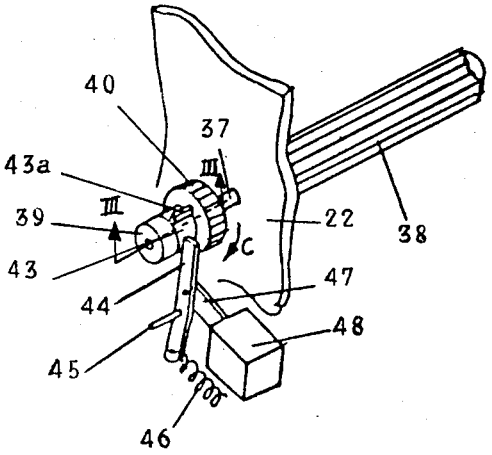
FIG. 2 is a fragmentary perspective view of a part of the device of FIG. 1.
Figure 3:
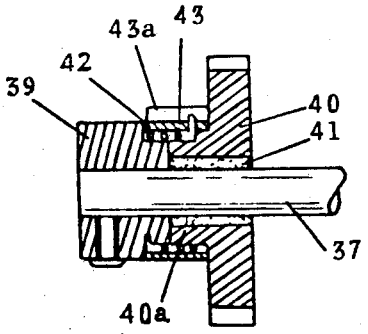
FIG. 3 is an enlarged sectional view taken along a line III—III shown in FIG. 2.

As shown in FIGS. 2 and 3, a driven member 39 is fixedly provided on one end of the shaft 37, and adjacent to the driven member 39 a gear wheel 40 having a boss 40*a* is supported through an oilless bearing 41 on the shaft 37 for rotating independently of the shaft 37 and the member 39. The gear wheel 40 is normally rotated by a driving device (not shown) in a direction of an arrow C. A coiled spring 42 is wound closely around the circumference of the driven member 39 and the boss 40*a* of the gear wheel 40, and loosely provided around the outer periphery of the coiled spring 42 is a collar 43 which is formed on its outer periphery with a projection 43*a*. The coiled spring 42 is fixed at its one end to the collar 43 and at the other end to the driven member 39, the winding of the spring being such that it is firmly fitted under resilience to the boss 40*a* of the gear wheel 40 and the driven member 39 to transmit the rotational force from the gear wheel 40 to the driven member 39 and released against the action of its resilience when the driven member 39 is rotated in the direction of the arrow C with the collar 43 arrested against rotation. There is provided a lever 44 pivotally supported on a pivot 45 which is fixed to a wall of the casing 22. An upper end of the lever 44 abuts against the periphery of the collar 43 under the action of a tension spring 46 provided between a lower end of the lever 44 and a wall portion of the casing 22. The lever 44 is pivotally connected to a plunger 47 associated with a solenoid 48 which can be momentarily energized. When the solenoid 48 is momentarily energized to retract the plunger 47, the lever 44 is pivotally moved against the action of the spring 46 to disengage the upper end of the lever 44 from the projection 43*a* of the collar 43, and thus the member 39 and the gear wheel 40 are locked by the spring 46 and rotated together by one revolution to supply an additional amount of the toner from the tank 32 to the casing 22 as described above.

Figure 4:
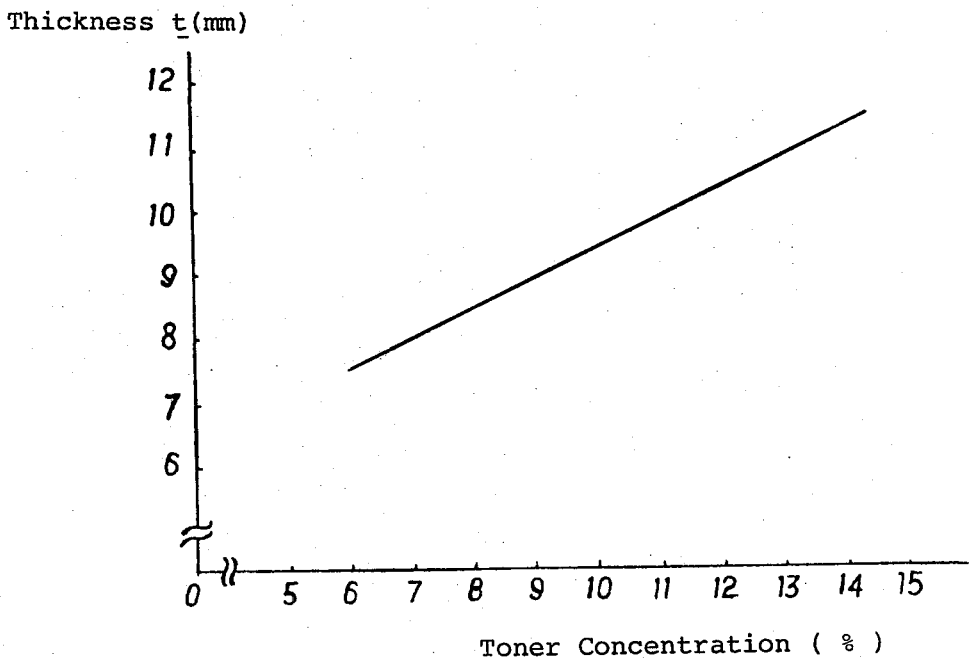
FIG. 4 is a graph showing characteristics of the device of FIG. 1.

In the developing device, a depth or thickness t of the flow of the developing agent on the upper surface of the scraping plate 30 is varied in response to changes in the toner concentration of the developing agent. FIG. 4 shows a relationship between the toner concentration percentage of the developing agent and the thickness t of the flow of the developing agent on the scraping plate 30. The thickness of the flow of the developing agent was measured by using a brass scraping plate 30 at an angle of about 15° relative to the horizontal plane, using a developing agent including toner made of a synthetic resin particles having a mean particle diameter of about 12 microns and carrier made of iron particles having a mean particle diameter of about 50 microns, and using the device of FIG. 1 to measure at a position spaced by about 25 milli-meters apart downstream of the leading end of the scraping plate 30. It will be understood from FIG. 4 that the thickness of the flow of the developing agent is increased in proportion to increase in the toner concentration of the developing agent.

Figure 5:
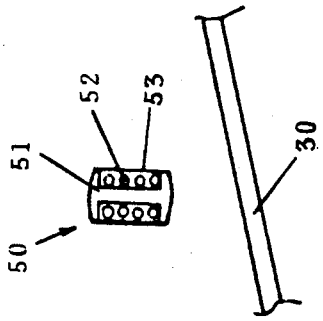
FIG. 5 is a schematic and enlarged sectional view of a different part of the device of FIG. 1.

Above and apart from the scraping plate 30, a detecting device 50 is provided as shown in FIGS. 1 and 5. The detecting device 50 comprises a ferrite core 51 generally H-shaped in section, a coil 52 wound around a periphery of the core 51 and a film-like member 53 made of a synthetic resin material covering the coil 52 to prevent the coil from directly contacting with the developing agent. The detecting device 50 is disposed so that when the toner concentration of the developing agent is at an intended value or higher its lower end is in contact with the developing agent flowing on the scraping plate 30, and on the other hand when the toner concentration is less than that value the lower end is out of contact with the developing agent. For example, if it is desired to set the toner concentration to 9%, the detecting device 50 is positioned such that its lower end should be spaced about 9 milli-meters from the upper surface of the scraping plate 30.

Figure 6:
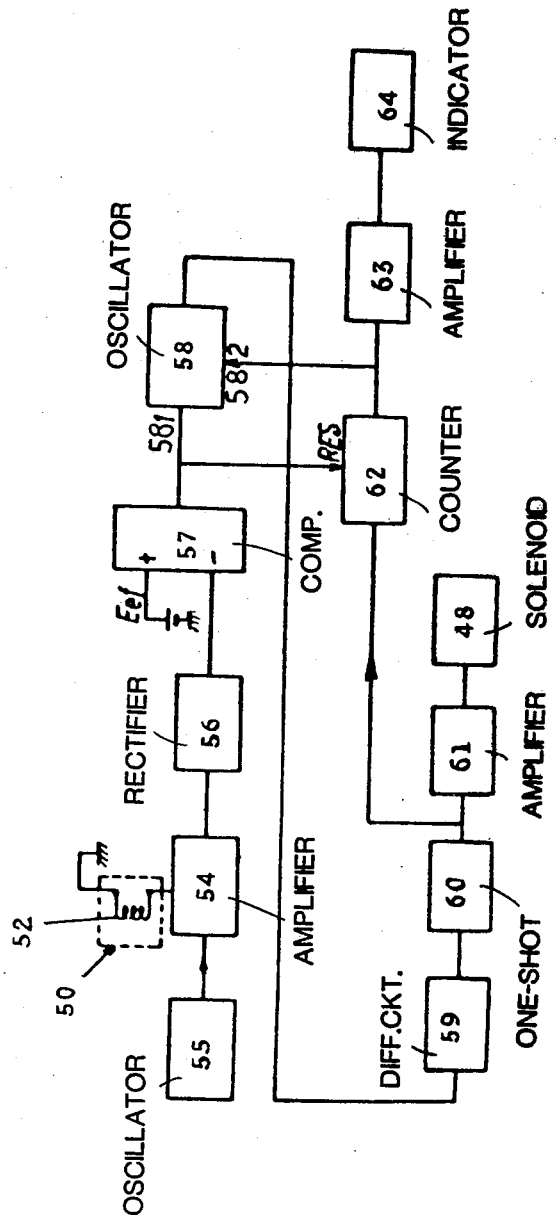
FIG. 6 is a block diagram of an electric circuit of the control device of FIG. 1.

FIG. 6 shows an electrical control circuit of the device according to this invention. The coil 52 of the detecting device 50 is connected at its one end to a feedback circuit of a narrow band amplifier 54 which only amplifies a signal within an amplification frequency band. The other end of the coil 52 is earthed. The amplification frequency band is changed in accordance with changes of the inductance of the coil 52 in such a manner that when the detecting device 50 is out of contact with the developing agent the amplification frequency band is $f_1$, and when the detecting device is in contact with the developing agent the amplification frequency band changes to $f_2$ which is not overlapped to band $f_1$. On the other hand, a signal of frequency $f_0$ within the amplification frequency band $f_1$ is supplied from a oscillator 55 to an input terminal of an amplifier 54. The signal $f_0$ is amplified and supplied to a rectifier 56, only when the detecting device is out of contact with the developing agent. The output of the rectifier 56 is supplied to an inverting input terminal of a comparator 57, and a non-inverting input terminal thereof is supplied with a reference voltage $E_{ef}$. The output voltage of the comparator 57 is zero or a negative potential when the signal derived from the rectifier 56 is high in comparison with the reference voltage $E_{ef}$ or when the device 50 is out of contact with the developing agent, and positive when the device 50 is in contact with the developing agent. The output of the comparator 57 is supplied to an oscillation control terminal 581 of an oscillator 58 which produces a relatively low frequency signal when the terminal 581 is at zero or a negative potential. The oscillator 58 also has another oscillation control terminal 582 for controlling the oscillation of the oscillator 58. The output of the oscillator 58 is differentiated by a differential circuit 59 and then supplied to a mono-stable multivibrator 60 which, in turn, converts it to pulses produced at appropriate intervals of time. This pulse is amplified by an amplifier 61 and then supplied to the solenoid 48 to energize it. Thus, when the detecting device 50 is out of the developing agent the solenoid 48 is energized at the intervals, so that the supply roller 38 is continuously rotated to supply the toner to the interior of the casing 22 until the toner concentration reaches the intended value.

There may occur a risk that the toner concentration of the developing agent is reduced below the appropriate value, while no toner is contained in the tank 32, and thus the solenoid 48 will be indefinitely energized to continuously rotate the supply roller 38. To avoid this, there is provided a means for removing such a risk and indicating lack of the toner in the developing agent.

In FIG. 6, a reference numeral 62 indicates a counter for counting a number of the generation of the output of the mono-stable multivibrator 60 and generates an output signal when counting the tenth output of the multivibrator 60. The output of the counter 62 is amplified by an amplifier 63 and then supplied to an indicator 64, such as a lamp, to energize it. The indicator 64 is provided on a control panel of the electrophotographic apparatus for warning lack of the toner in the developing agent to the operator. The output signal of the counter 62 is also supplied to the oscillation control terminal 582 of the oscillator 58 to stop the oscillation of the oscillator 58 thereby de-energizing the solenoid 48 while the output signal derived from the comparator 57 is zero or negative. On the other hand, the output derived from the comparator 57 is supplied to a re-set terminal RES of the counter 62, and when the detecting device 50 is in contact with the developing agent, namely, when the output of the comparator is positive the counter 62 is re-set in the initial condition.

In the embodiment described above, the amplification frequency band of the oscillator 55 is set at $f_1$ when the device 50 is out of contact with the developing agent and at $f_2$ when such contact takes place, but alternatively, the frequency may be set at $f_2$ when no such contact occurs, and at $f_1$ when such contact occurs, and in this case the output of the rectifier 56 is supplied to the non-inverting input terminal and the reference signal $E_{ef}$ is supplied to the inverting input terminal.

Figure 7:
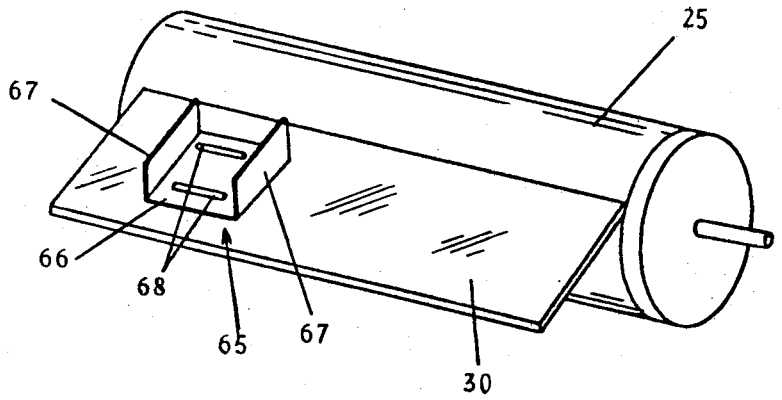
FIG. 7 is a perspective view showing another embodiment of the device of the invention.
Figure 8:
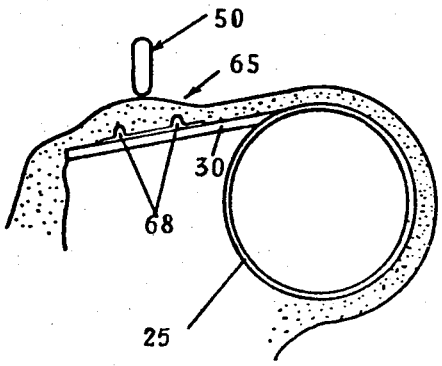
FIG. 8 is a sectional view of the device of FIG. 7.

FIGS. 7 and 8 shows another embodiment of the device in accordance with the present invention and the same numerals as those of FIG. 1 designate similar parts. In this embodiment, a plate-like member 65 is provided on such an area of the upper surface of the scraping plate 30 as is facing the detecting device 50. The member 65 includes a thin bottom plate portion 66 fixed to provide no substantial obstruction to the flow of the developing agent on the member 65 and side plate portions 67 which are bent to project upwardly from opposite sides of the bottom plate portion 66. The side plate portions 67 extend in parallel with each other in the direction of the flow of the developing agent. The member 65 also includes a pair of parallel bars lying laterally on the portion 66 and protruded upwardly from the upper surface of the bottom plate portion 66, such that a part of the developing agent flowing on the portion 66 of the member 65 is impinged against the bars 68 to form a swelling portion as seen in FIG. 8 and the thickness of this swelling portion of the developing agent is detected by the detecting device 50. In this embodiment, the distance between the bars 68 is 12 milli-meters and the height of them is 2 milli-meters. Similar experiments to those made with the device of FIG. 1 were made and it was observed that when the toner concentration was changed from 9% to 10% the thickness of the flow was varied by about 4 to 5 millimeters and the rate of changes in the thickness of the flow was increased in comparison with that in case of no provision of the member 65.

Figure 9:
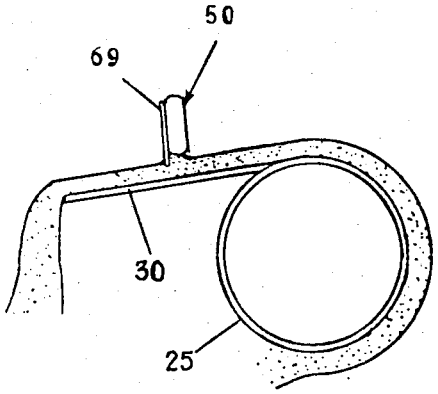
FIG. 9 is a sectional view of a further embodiment of the device of the invention.

FIG. 9 shows a further embodiment of the device according to this invention. In this embodiment, a plate 69 formed of non-magnetizable material is mounted on a rear side of the detecting device 50, and a lower end of the plate 69 slightly protrudes from the lower end of the detecting device 50. The developing agent flowing on the scraping plate 30 impinges to the plate 69 to provide a swelling portion, and the detecting device 50 is brought into contact with this swelling portion to provide precise control of the toner concentration.

Figure 10:
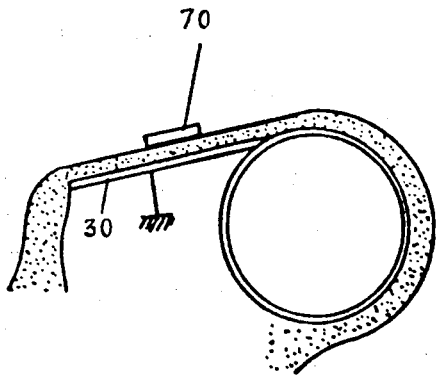
FIG. 10 is a sectional view of a still further embodiment of the device of the invention.

FIG. 10 shows a modified embodiment of the detecting device in which the scraping plate 30 is formed of an electrically conductive material and earthed, an electrode 70 being provided apart from the plate 30 at a predetermined distance and connected to the feedback circuit of the amplifier 54 of the control circuit shown in FIG. 6, and the electrode 70 detects changes in the capacitance between it and the plate 30 caused by the variation in the thickness of the developing agent flowing therebetween, thereby controlling the metering means 34.

Figure 11:
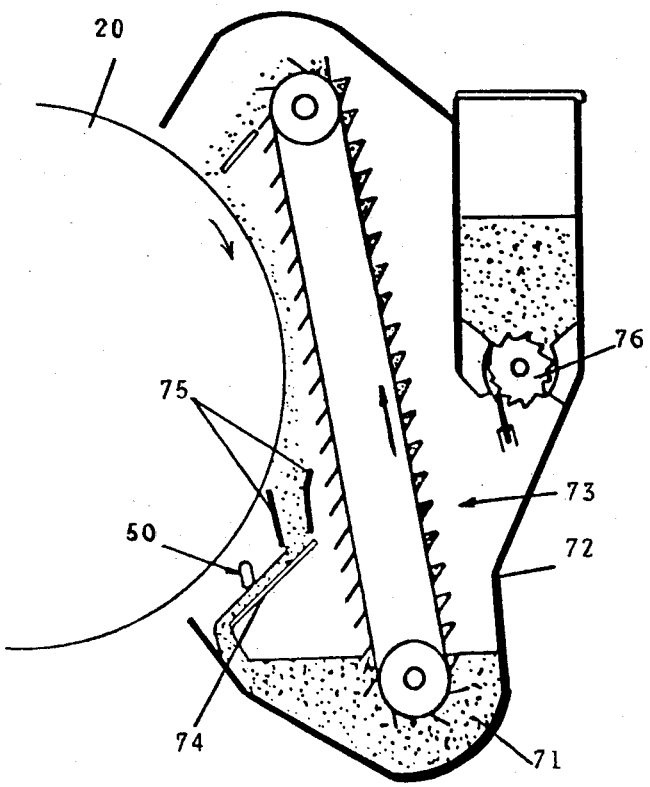
FIG. 11 is a schematic sectional view of a part of an electrophotographic apparatus which includes another developing device incorporating the features of the invention.

FIG. 11 shows a cascade type developing device to which the present invention is applied. A developing agent 71 is of a similar type as that described in respect of the aforementioned embodiments. The developing agent 71 is contained in a casing 72 and conveyed by a bucket conveyor 73 for cascading it over the periphery of a photosensitive drum 20 which has been formed with an electrostatic latent image. The developing agent which has participated in the development of the image is dropped to an inclined plate and thereafter the developing agent is subjected to flow along the plate 74 into the stored developing agent 71. A reference numeral 75 designates guide plates which are, if necessary, provided to prevent the falling developing agent from being scattered. A detecting device 50 similar to that of the first-mentioned embodiment is spaced an appropriate distance from the upper surface of the plate 74, and when the developing agent flowing on the plate 74 is out of contact with the detecting device 50, a supply roller 76 is rotated to supply the toner to the casing 72.

What is claimed is:

1. A device for controlling toner concentration of a developing agent used in an electrophotographic apparatus wherein an electrostatic latent image is developed by a developing agent including toner and magnetizable carrier comprising:

(a) storage means for storing the developing agent;
(b) toner supply means for supplying a toner into said storage means;
(c) a magnet-brush sleeve to convey the developing agent for developing the latent image;
(d) an inclined scraping member for scraping from said magnet-brush sleeve the developing agent which has participated in the development of the image, so that the developing agent flows along an upper surface of said scraping member;
(e) detecting means spaced by a predetermined distance from said upper surface of said scraping member, said detecting means detecting the thickness of the flow of the developing agent dependent on whether or not said developing agent contacts said detecting means, and
(f) means for metering toner from said toner supply means to said storage means when the developing agent is not in contact with said detecting means.

2. A device according to claim 1 wherein said detecting means is spaced by a predetermined distance from said upper surface of said inclined member, and the detection of the thickness of the flow of the developing agent is dependent on whether or not said developing agent contacts said detecting means.

3. A device according to claim 2 wherein said detecting means comprises a non-magnetic core, a coil wound around a periphery of said core and an insulator covering a periphery of said coil to prevent said coil from directly contacting with said developing agent; whereby the inductance of said coil depends upon said developing agent being in contact with said detecting means.

4. A device according to claim 3 further comprising a non-magnetic member mounted on a downstream side of said detecting means to protrude its lower end from that of said detecting means.

5. A device according to claim 1 wherein said inclined member includes a bar member lying laterally on the upper surface thereof and projecting therefrom so as to cause a swelling portion of the flow of the developing agent, the thickness of said swelling portion being detected by said detecting means.

6. A device according to claim 5 wherein said inclined member further includes side members for defining the flow of the developing agent passing over said bar member.

7. A device according to claim 1 wherein said detecting means comprises an electrode for detecting capacitive changes caused by variation in the thickness of said developing agent on said inclined member.

* * * * *